US011083235B2

(12) United States Patent
Feng

(10) Patent No.: US 11,083,235 B2
(45) Date of Patent: Aug. 10, 2021

(54) INSULATED GLOVES

(71) Applicant: Nantong Jiadeli Safety Products Co., Ltd., Jiangsu (CN)

(72) Inventor: Hua Feng, Jiangsu (CN)

(73) Assignee: Nantong Jiadeli Safety Products Co., Ltd, Nantong (CN)

( * ) Notice: Subject to any disclaimer, the term of this patent is extended or adjusted under 35 U.S.C. 154(b) by 55 days.

(21) Appl. No.: 16/528,346

(22) Filed: Jul. 31, 2019

(65) Prior Publication Data

US 2020/0093204 A1 Mar. 26, 2020

(30) Foreign Application Priority Data

Sep. 23, 2018 (CN) ..... 201811111425.4

(51) Int. Cl.
*A41D 19/015* (2006.01)
*A41D 19/00* (2006.01)

(52) U.S. Cl.
CPC ..... *A41D 19/01529* (2013.01); *A41D 19/001* (2013.01); *A41D 19/0006* (2013.01); *A41D 19/0068* (2013.01)

(58) Field of Classification Search
CPC ..... A41D 19/01529; A41D 19/0068; A41D 19/001; A41D 19/0006
See application file for complete search history.

(56) References Cited

U.S. PATENT DOCUMENTS 4,723,324 A * 2/1988 Lassiter ..... A41D 19/01547 2/160
2004/0111782 A1* 6/2004 Lenormand ..... A41D 31/065 2/69
2005/0100728 A1* 5/2005 Ristic-Lehmann ..... C08K 3/36 428/323
2006/0037815 A1* 2/2006 Schabel, Jr. ..... E04B 1/88 181/290
2006/0216499 A1* 9/2006 Nuckols ..... C10M 147/02 428/332
2007/0044200 A1* 3/2007 Y'srael ..... A41D 19/01529 2/159
2016/0100638 A1* 4/2016 Megat Abdul Aziz ..... B29C 41/40 2/163
2016/0286874 A1* 10/2016 Kishihara ..... A41D 19/0006

FOREIGN PATENT DOCUMENTS

CN 206324282 U 7/2017
CN 206978845 U 2/2018
CN 207821181 U 9/2018
GB 782520 A * 9/1957 ..... B29D 99/0067

* cited by examiner

*Primary Examiner* — Tahseen Khan

(57) ABSTRACT

An insulated glove, including a covering, a lining and a plurality of heat insulators. The lining is sheathed in the covering, and the lining and the covering form a sandwich structure. Each of the heat insulators includes a first connecting end and a second connecting end which are respectively connected to the covering and the lining, so that the heat insulators are located in the sandwich structure. A cavity capable of insulating heat is formed between the heat insulators, the lining and the covering. The glove has a simple and reasonable structure and is flexible and convenient to use, which has good heat insulation and anti-scald effect, as well as an anti-shock effect.

7 Claims, 2 Drawing Sheets

INSULATED GLOVES

CROSS-REFERENCE TO RELATED APPLICATIONS

This application claims the benefit of priority from Chinese Patent Application No. 201811111425.4, filed on Sep. 23, 2018. The content of the aforementioned application, including any intervening amendments thereto, is incorporated herein by reference in its entirety.

TECHNICAL FIELD

The present invention relates to gloves, and more particularly to insulated gloves.

BACKGROUND OF THE INVENTION

Gloves, as the personal protective equipment, play an important part in protecting workers' hands during industrial production. There are various types of protective gloves, such as cut-resistant, dielectric, waterproof, cold-resistant, heat-insulating, thermal radiation protective, fireproof gloves or gloves with other functions.

Heat insulating and anti-scald gloves are used in a high-temperature environment, and workers are often required to wear gloves to work intermittently under high temperature of different degrees Celsius. For example, the insulated gloves are used by plumbers for high-temperature pipeline maintenance or in the casting industry and the metallurgy industry.

On one hand, heat is insulated by the existing insulated gloves to some extent by thickening the glove or adding insulation felts in the glove. However, this method makes the gloves inflexible, and the grip strength thereof is not strong, so high temperature objects of small sizes cannot be accurately held during the operating. On the other hand, the insulating effect of the existing insulated gloves is improved by developing novel insulating materials, such as high-temperature glass beads. However, it has an immature technique process and a high cost, so it cannot be widely used at present.

Therefore, the target of the related industry is to overcome the above-mentioned shortcomings in the prior art. In view of this, the inventor has designed and proposed the present invention to make an improvement on the prior art through long-term experiences and extensive experiments.

For example, Chinese Patent Application No. 201720905717.X discloses an insulated glove with beads, comprising a lining. The lining comprises a back portion, a palm portion, a finger portion and a wrist portion. The palm portion and the finger portion of the lining are covered with a dipped layer. A plurality of tapered beads are regularly distributed on a surface of the dipped layer. However, the beads are provided on an outer surface of the glove, which achieves poor insulating and anti-scald performance. Moreover, the beads on the glove surface are easy to fall due to abrasion, so that the insulating and anti-scald effect of the glove is greatly reduced.

Chinese Patent Application No. 201720544569.3 discloses an anti-scald and insulated glove, comprising a glove body. The glove body is provided with five fingers which are separated, and a plurality of insulator pieces fitted with shapes and sizes of bone structures of the fingers and the palm are respectively provided at inner sides of the fingers and the palm of the glove body. The anti-scald and insulating effect is realized by adopting the insulator plates, but the insulator pieces lead to awkwardness and inconvenience of the glove during use.

Chinese Patent Application No. 201720736508.7 discloses ananti-slip and insulated glove, comprising a glove body composed of an outer insulated layer and an inner waterproof layer which are arranged in a sheathed manner. The glove body comprises a palm portion, a thumb portion and four-finger portion which are in a one-piece structure. A plurality of first protrusions provided at front surfaces of the thumb portion and the four-finger portion extend in a direction perpendicular to a length direction of the glove body. A plurality of second protrusions are provided at edges of the thumb portion and the four-finger portion to form an area in which the thumb portion and the four-finger portion are located. In this invention, insulating effect is realized by filling materials such as rubbers in interlayer of the glove to increase the thickness of the glove. However, the glove is only suitable for holding objects with fingers because heat insulator pieces are not provided at the palm portion, moreover, it is inconvenient to wear.

SUMMARY OF THE INVENTION

In view of the above technical solutions, the present invention provides a glove that allows the operator to have a comfortable wearing experience and has good insulating, anti-scald and anti-shock effect. Provided is an insulated glove, comprising a covering, a lining and a plurality of heat insulators. The lining is sheathed in the covering, and the lining and the covering form a sandwich structure.

Each of the heat insulators comprises a first connecting end and a second connecting end which are respectively connected to the covering and the lining, so that the heat insulators are located in the sandwich structure. A cavity capable of insulating heat is formed between the heat insulators, the lining and the covering.

In an embodiment, a total volume of the heat insulators is 10-15% of a volume of the cavity.

In an embodiment, a distance between the first connecting end and the second connecting end ranges from 2 to 5 mm.

In an embodiment, the heat insulators are made of rubbers, PU or PVC materials by thermoforming.

In an embodiment, the heat insulators are columns, spheres or hemispheres, and the heat insulators adjacent to each other are arranged in a point or line contact in the sandwich structure.

In an embodiment, the heat insulators are elongated columns, and are arranged in the sandwich structure in a parallel or intersecting manner.

In an embodiment, a plurality of through holes are evenly provided on the heat insulators, and are configured to improve a volume ratio of air in the cavity.

In an embodiment, a dipped layer is provided on an outer side of the covering. The dipped layer is made from neoprene by double dip molding.

In an embodiment, the dipped layer is provided with a sandblasting layer formed by a pressures and blasting process.

In an embodiment, the lining is a 10-gauge acrylic loop pile glove, and a thickness at thumb crotch of the lining is larger than that at other parts of the lining.

Compared to the prior art, the present invention has the following beneficial effects.

1. A structure with a hollow cavity is provided between the covering, the heat insulators and the lining, so 85-90% of the heat outside the glove is transferred via the air having low heat conductivity, thus the insulating and anti-scald effect of the glove is obviously improved.

2. The cavity is as a whole in which the heat insulators serve as a skeleton and are made of elastic materials. The cavity is mainly filled with air. Like an automobile tire, a dipped layer and a fiber layer are respectively coated on inner and outer surfaces of the cavity to form a structure similar to an air shock absorber, thus realizing a good shock absorption.

3. The sandblasting layer is provided on the glove surface. On the one hand, it reduces the possibility of accidents, such as crash and extrusion of objects, caused by slippage when the object is grasped by the worker. On the other hand, the roughness of the glove surface is increased to improve mechanical properties of the glove surface, such as the wearability, the cut resistance and the fatigue resistance, so that the service time of the glove is prolonged, where the service time of the sandblasting glove is 3-5 times that of ordinary gloves.

BRIEF DESCRIPTION OF THE DRAWINGS

The non-restrictive embodiments are described in detail with reference to the accompanying drawings, from which other features, purposes and advantages of the present invention will be more apparent.

Figure 1:
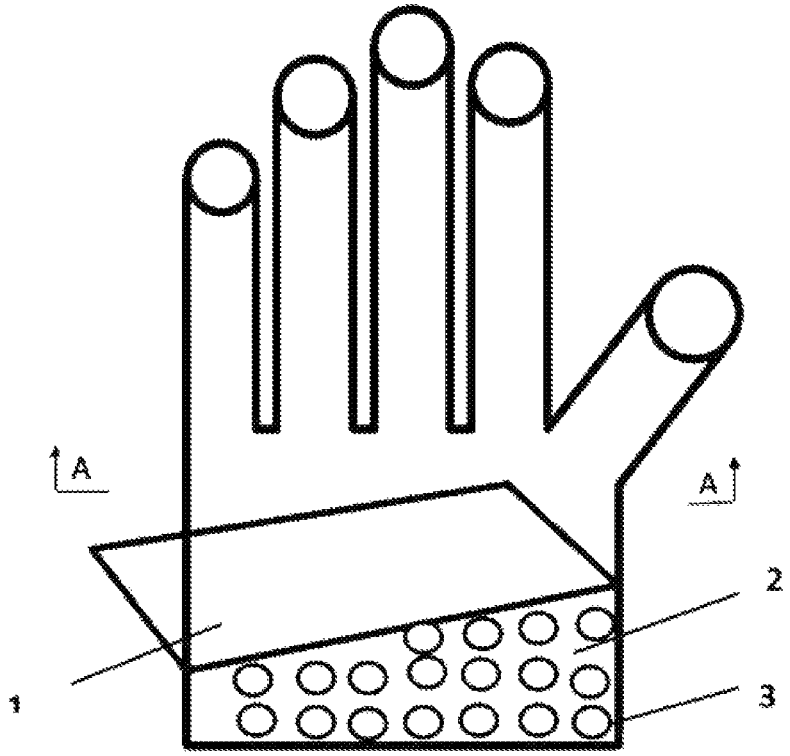
FIG. 1 is a schematic diagram of an insulated glove according to the present invention.

Reference numerals: 1, covering; 2, lining; 3, heat insulator; 31, first connecting end; 32, second connecting end; 33, through hole; 4, sandwich structure; 5, cavity.

DETAILED DESCRIPTION OF EMBODIMENTS

The following embodiments are intended to help those skilled in the art to further understand but not intended to limit the present invention. It should be noted that various modifications and improvements can be made by those skilled in the art without departing from the spirit and scope of the invention.

Example 1

Figure 2:
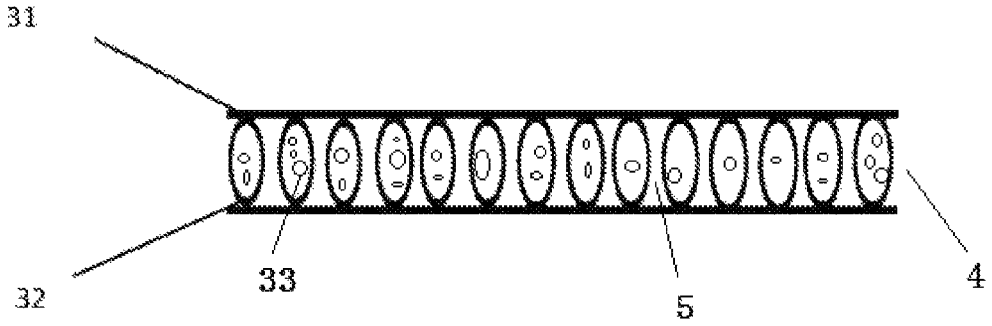
FIG. 2 is a sectional view of the insulated glove taken along A-A in FIG. 1.

As shown in FIGS. 1 and 2, illustrated is an insulated glove, comprising a covering 1, a lining 2 and a plurality of heat insulators 3. The covering 1 is made of 10-gauge, 13-gauge, 18-gauge or 21-gauge polyester-cotton blended materials or chemical fiber materials by a knitting technique. The lining 2 is a 7-gauge, 10-gauge, 13-gauge or 18-gauge loop pile glove made of acrylic fibers, spandex or nylon by a knitting technique. The lining 2 is sheathed in the covering 1, and the covering 1 and the lining 2 form a sandwich structure 4.

Each of the heat insulators 3 comprises a first connecting end 31 and a second connecting end 32 which are respectively connected to the covering 1 and the lining 2 via an adhesive, so that the covering 1 and the lining 2 are separated by the heat insulators 3, and a hollow structure having the same height with the heat insulators is formed in the sandwich structure 4 formed by the covering 1 and the lining 2. The covering 1 and the lining 2 are sealed at the opening of the glove by a sealing process, so a cavity 5 having a hollow structure is formed between the covering 1, the lining 2 and the heat insulators 3. Alternatively, the lining is made from cotton, aramid or Kevlar fibers, and is dipped in a nitrile-butadiene rubber, silica gel, latex or PVC, so that beads, blocks, stripes or irregular patterns are formed on the lining. Each of the beads has a height of 0.2-1 cm, and the beads are an insulating layer. The covering 1 is a craft glove, such as flexible foaming gloves, rigid foaming gloves, smooth gloves, scrub mitts, rubber crinkle gloves and rubber scrub mitts, which is processed by dipping nylons, polyesters, graphenes, etc. in a mixture of nitrile-butadiene rubber and neoprene. The lining is thickened and densely made at thumb crotch. Alternatively, the thumb crotch area is coated with a mixed nitrile-butadiene rubber, a mixed latex, a mixed PVC or a mixed silicone gel. Then, the covering and the lining are combined by overlocking.

In some embodiments, a plurality of through holes 33 are provided on the heat insulators 3, and are configured to increase air volume in the cavity 5.

When hands are in a high temperature or an object of a high temperature is grasped by the hand, heat is transferred from the covering 1 to the cavity 5, and then transferred to the lining 2 via the heat insulators 3 and the air in the cavity 5, and finally transferred to the hands via the lining 2.

In above heat transfer process, the cavity 5 is between the lining and the covering, and there are two transfer ways.

1. External heat of a high temperature contacts with an outer surface of the covering 1, and then is transferred to the lining 2 via the heat insulators 3 in the cavity 5, and then to an inner surface of the lining 2, and finally, it is transferred to the hand.

2. External heat of the high temperature contacts with an outer surface of the covering 1, and then is transferred to the lining 2 via the air in the cavity 5, and then to an inner surface of the lining 2, and finally, it is transferred to the hand.

In above two transfer ways, the heat insulators and the air serve to transfer heat, and heat conductivity thereof is obtained by the following formulas.

(1) Heat conductivity of solids: the steady-state method is adopted to test a thin-film sample, and heat conductivity is calculated by a traditional one-dimensional heat conduction model and formula thereof. A calculation formula of the heat conductivity derived from Fourier's law is expressed as:

$$\lambda = \frac{ql}{T1 - T2},$$

where T1 and T2 (° C.) respectively refer to the temperature of upper and lower surfaces of the sample; q refers to the heat flux density ($W/m^2$) of a bottom of the sample; λ refers to the heat conductivity (m.° C.) of the sample; L refers to the thickness of the sample, and when the thickness L of the sample is small, influence of the sidewall is ignored, so the model is approximated as in one dimension.

(2) Heat conductivity of gases: according to kinetic theory of gases, the heat conductivity of gases is expresses as:

$$\lambda = \tfrac{1}{3}CVVL,$$

where C is the heat capacity (J/K) of gases per volume; V is the average speed (m/s) of the gas molecule; L is the mean free path (m) of the air molecules' collisions. Therefore, the heat conductivity of the gas is determined by C, V and L of the gas. As the temperature rises, the velocity of the gas molecules sharply increases due to an increase of internal energy, so the heat conductivity of gases rises as the temperature increases. In fact, most industrial gases except for H2 have a substantially same heat conductivity which is much less than that of the solids.

According to above two formulas, the heat conductivity of related materials are shown in Table 1.

TABLE 1

Heat conductivity of related substances

| Materials | Heat conductivity (W/mK) |
|---|---|
| Copper | 308 |
| Iron | 50 |
| High density polyethylene | 0.5 |
| Low density polyethylene | 0.33 |
| PU | 0.22 |
| Rubber | 0.19 |
| PVC | 0.17 |
| Air | 0.01-0.05 |

As shown in Table 1, the heat conductivity of air is 0.01-0.05 W/mK, which is far less than that of the solids.

Since the cavity 5 with a hollow structure is formed between the covering 1, the heat insulators 3 and the lining 2, and is filled with air during the heat conduction process, so a part of the heat is transferred through gases. However, the heat conductivity of air is small, so it can effectively prevent the heat transfer, thus achieving good insulating effect.

In some embodiments, a total volume of the heat insulators 3 is 10-15% of a volume of the cavity 5. Thus, a volume of air is 85-90% of the volume of the cavity 5, i.e., 85-90% of the heat which is transferred from the external side of the covering contact the air in the cavity 5, and then is transferred to the lining 2 via the air, and finally to the hand via the lining 2. The heat conductivity of air is 0.01-0.05 W/mK, which is very low, resulting in a very slow process for transferring the heat. In addition, due to a high ratio of a volume of the air to that of the cavity 5, the heat conductivity of the cavity 5 is greatly reduced, thus realizing better heat insulating and anti-scald effect.

According to heat conduction mechanism, the heat conduction is a transfer for internal energies between high energy state and high temperature microparticles and low energy state and low temperature microparticles during collisions, i.e., the heat flows from the high temperature area to the low temperature area until the temperature in the two areas reaches a balance. Due to the low heat conductivity of the cavity 5, when the external high temperature heat transfers from the covering 1 to the cavity 5, a heat insulation zone is formed in the cavity 5 to carry the heat, and the heat in the heat insulation zone is slowly transferred to the lining. Moreover, the lining 2 can dissipate heat to some extent, so the heat which contacts the hand is greatly reduced.

The cavity is as a whole in which the heat insulators 3 serve as a skeleton, and the cavity is filled with air. Like an automobile tire, a dipped layer and a fiber layer are respectively coated on inner and outer surfaces of the cavity to form a structure similar to an air shock absorber, thus realizing good shock absorption.

Further, a distance between the first connecting end 31 and the second connecting end 32 is 2-5 mm, and the distance is a vertical distance between inner surfaces of the covering 1 and the lining 2 in the cavity 5. The distance of 2-5 mm avoids that the inner surface of the covering 1 contacts with the inner surface of the lining 2 during operating with the glove, so that most heat in the cavity 5 is transferred by the air which has a low heat conductivity to ensure the insulating effect.

Experiment shows when the vertical distance between the inner surface of the covering 1 and the inner surface of the lining 2 is less than 2 mm, the contact area thereof increases because the glove will suffer a tension when it is worn by the hand, especially, when the glove is used to grasp objects, 50-60% of the inner surfaces of the covering and the lining are contacted. According to the heat conductivity in Table 1, the solid with larger heat conductivity causes a worse heat insulating and anti-scald effect of the glove.

When the vertical distance between the inner surface of the covering 1 and the inner surface of the lining 2 is more than 5 mm, the heat insulators 3 are very high, which leads to the tilt or even dumping of the heat insulators 3 in the glove because the glove will suffer a tension when it is worn by the hand. Then, the contact area of the heat insulators and the inner surfaces of the covering 1 and the lining 2 increases, especially when the glove is used to grasp objects, the contact area thereof is increased by 20-30%, thereby causing an increase of heat conduction amount between the solids. According to the heat conductivity in Table 1, the solids have a larger heat conductivity, greatly reducing the insulating and anti-scald effect of the glove. Moreover, when the vertical distance between the inner surface of the covering 1 and the inner surface of the lining 2 is more than 5 mm, the glove has a larger thickness, so the glove is inconvenient and inflexible to use and has a small grip strength when it is worn, and the high temperature object with a small size cannot be accurately held during the operation.

In some embodiments, the heat insulators 3 are made of rubbers, PU or PVC materials by thermoforming. As shown in Table 1, the heat conductivity of PVC, rubbers and PU are respectively 0.17 W/mK, 0.19 W/mK and 0.25 W/mK, so PVC, rubbers and PU all have a low heat conductivity, which can further improve the insulating and anti-scald effect of the glove. Moreover, the PVC, rubbers and PU can further expand at high temperatures according to principles of the thermal expansion, so that the vertical distance between the first connecting end 31 and the second connecting end 32 of the heat insulators 3 increases, and accordingly, the vertical distance between inner surfaces of the covering 1 and the lining 2 increases, so that the air volume in the cavity 5 increases, which further improves the insulating and anti-scald effect of the glove.

In some embodiments, the heat insulators 3 are columns, spheres or hemispheres, and the heat insulators 3 adjacent to each other are arranged in a point or line contact in the sandwich structure 4. The spheres, hemispheres or columns, such as cuboids, cubes, trapezoidal columns, prisms and cylinders, etc., are evenly distributed in a point or line contact or are spaced with each other at a certain distance in the sandwich structure 4.

When the heat insulators 3 are beads in a shape of spheres, hemispheres or columns such as cuboids, cubes, trapezoidal columns, prisms and cylinders, the insulating effect of the glove is described as follows.

(1) When the beads are not in contact with each other, the ratio of the volume of the air to that of the cavity 5 is increased, and the ratio of the volume of the heat insulators 3 to that of the cavity 5 reaches 10%, which reduces heat transferred by the solids in the heat transfer process. Particularly, when the heat insulators 3 are in a spherical shape, the first connecting end 31 of each of the heat insulators 3 contacts with the covering 1, and the second connecting end 32 of each of the heat insulators 3 contacts with the lining 2 to realize the point contact, so that the heat transferred by the solids is further reduced, and the insulating effect is further improved.

(2) When the beads contact with each other in a point or line contact, although a ratio of a surface area of the heat insulators 3 to that of the cavity 5 is above 10%, it is still within 15%, so the heat transferred by the solids is greatly reduced in the heat transfer process, which realizes better insulating effect. At the same time, since the beads are connected with each other, the firmness of the heat insulators 3 is improved, thus the firmness of the cavity 5 is improved.

Example 2

As shown in FIGS. 1 and 2, illustrated is an insulated glove, comprising a covering 1, a lining 2 and a plurality of heat insulators. The covering 1 is made of 10-gauge, 13-gauge, 18-gauge or 21-gauge polyester-cotton blend materials or chemical fiber materials by a knitting technique. The lining 2 is a 7-gauge, 10-gauge, 13-gauge or 18-gauge loop pile glove made of acrylic fibers, spandex or nylon by a knitting technique. The lining 2 is sheathed in the covering 1, and the covering 1 and the lining 2 form a sandwich structure 4. Each of the heat insulators comprises a first connecting end 31 and a second connecting end 32 which are respectively connected to the covering 1 and the lining 2 via an adhesive, so that the covering 1 and the lining 2 are separated by the heat insulators 3, and a hollow structure having a same height with the heat insulators is formed in the sandwich structure formed by the covering 1 and the lining 2. The covering 1 and the lining 2 are sealed at the opening of the glove by a sealing process, so a cavity 5 having a hollow structure is formed between the covering 1, the lining 2 and the heat insulators 3.

When hands are in a high temperature or an object of a high temperature is grasped by the hand, heat is transferred from the covering 1 to the cavity 5, and then transferred to the lining 2 via the heat insulators 3 and the air in the cavity 5, and finally to the hand via the lining 2.

In some embodiments, a total volume of the heat insulators is 10-15% of a volume of the cavity 5. Thus, a volume of air is 85-90% of the volume of the cavity 5, i.e., 85-90% of the heat which is transferred from the external side of the covering contacts the air in the cavity 5, and then is transferred to the lining 2 via the air, and finally to the hands via the lining 2. The heat conductivity of air is 0.01-0.05 W/mK, which is very low, resulting in a very slow process for transferring the heat. In addition, due to a high ratio of the volume of the air to that of the cavity 5, the heat conductivity of the cavity 5 is greatly reduced, thus realizing better insulating and anti-scald effect.

According to heat conduction mechanism, the heat conduction is a transfer for internal energies between high energy state and high temperature microparticles and low energy state and low temperature microparticles during collisions, i.e., the heat flows from the high temperature area to the low temperature area until the temperature in the two areas reaches a balance. Due to the low heat conductivity of the cavity 5, when the external high temperature heat transfers from the covering 1 to the cavity 5, a heat insulation zone is formed in the cavity 5 to carry the heat, and the heat in the heat insulation zone is slowly transferred to the lining. Moreover, the lining 2 can dissipate heat to some extent, so the heat which contacts the hand is greatly reduced.

The cavity is as a whole in which the heat insulators 3 serve as a skeleton, and the cavity is filled with air. Like an automobile tire, a dipped layer and a fiber layer are respectively overlaid on the inner and outer surfaces of the cavity to form a structure similar to an air shock absorber, thus realizing good shock absorption.

Further, a distance between the first connecting end 31 and the second connecting end 32 is 2-5 mm, and the distance is a vertical distance between inner surfaces of the covering 1 and the lining 2 in the cavity 5. The distance of 2-5 mm avoids that the inner surface of the covering 1 contacts with the inner surface of the lining 2 during it is worn on the hand, so that most heat in the cavity 5 is transferred by the air which has a low heat conductivity to ensure the insulating effect.

The test shows when the vertical distance between the inner surface of the covering 1 and the inner surface of the lining 2 is less than 2 mm, the contact area thereof increases because tension is applied to the glove when it is worn on the hand, especially, when the glove is used to grasp objects, 50-60% of the inner surfaces of the covering and the lining are contacted. According to the heat conductivity in Table 1, the solid with larger heat conductivity causes worse insulating and anti-scald effect of the glove.

When the vertical distance between the inner surface of the covering 1 and the inner surface of the lining 2 is more than 5 mm, the heat insulators 3 are very high, which leads to the tilt or even dumping of the heat insulators 3 in the glove because tension is applied to the glove when it is worn on the hand. Then, the contact area of the heat insulators and the inner surfaces of the covering 1 and the lining 2 is increased, especially when the glove is used to grasp objects, the contact area thereof is increased by 20-30%, thereby causing an increase of heat conduction amount between solids. According to the heat conductivity in Table 1, the solids have a larger heat conductivity, greatly reducing the insulating and anti-scald effect of the glove. Moreover, when the vertical distance between the inner surface of the covering 1 and the inner surface of the lining 2 is more than 5 mm, the glove has a larger thickness, so the glove is inflexible and is not inconvenient to use, and has a small grip strength when it is worn. The small-sized object at high temperature cannot be accurately held during the operation.

In some embodiments, the heat insulators 3 are made of rubbers, PU or PVC materials by thermoforming. As shown in Table 1, the heat conductivity of PVC, rubbers and PU are respectively 0.17 W/mK, 0.19 W/mK and 0.25 W/mK, so PVC, rubbers and PU all have low heat conductivities, which can further improve the insulating and anti-scald effect of the glove. Moreover, the PVC, rubbers and PU can further expand at the high temperature according to principles of the thermal expansion, so that the vertical distance between the first connecting end 31 and the second connecting end 32 of the heat insulators 3 increases, and accordingly, the vertical distance between inner surfaces of the covering 1 and the lining 2 increases, so that the air volume in the cavity 5 increases, which further improves the insulating and anti-scald effect of the glove.

In some embodiments, the heat insulators 3 are elongated columns, and are arranged in the sandwich structure 5 in a parallel or intersecting manner. The column is an elongated cube, prism or cylinder.

When the heat insulators 3 are elongated cubes, prisms or cylinders, the insulating effect of the glove is described as follows.

(1) When the elongated columns are not in contact with each other, compared to the beads, a contact area between the first connecting end 31 of each 32 of the heat insulators and the covering 1 and a contact area between the second connecting end 32 of each of the heat insulators and the lining 2 increases, but less heat insulators 3 are arranged in the cavity because the covering 1 and the lining 2 can be separated to avoid their contacting. Specifically, when edges of the heat insulators 3 are connected to the covering 1 and the lining 2, i.e., the heat insulators 3 contact with surfaces of the covering 1 and the lining 2 in a line contact, the contact area between the solids is greatly reduced, and the ratio of a surface area of the heat insulators 3 to that of the cavity 5 is reduced within 15%, so that the heat transferred between the solids is greatly reduced, and the insulating and anti-scald effect of the glove is improved.

(2) When the heat insulators are arranged in an intersecting manner, such as a cross shape, X shape, Y shape, T shape, etc., the connection between the heat insulators is tight to increase a support strength thereof, so the number of the heat insulators 3 in the cavity 3 is further reduced, and the contact surface between the heat insulators 3 and inner surface of the covering 1 and the outer surface of the lining of the glove is reduced. Accordingly, air having a low heat conductivity in the cavity 5 increases, so that a ratio of a surface area of the heat insulators 3 to that of the cavity 5 is reduced to 10%, resulting in improved insulating and anti-scald effect. At the same time, the stability of the cavity 5 and the firmness of the glove are improved.

Further, a plurality of through holes are evenly provided on the elongated columns, and are configured to increase a ratio of gases to the cavity 5. The through holes on the elongated columns reduce the contact surface of the solids, and improve the impact of the heat conductivity of the air in the cavity 5. As a result, the heat conductivity of the cavity is reduced, and the insulating and anti-scald effect of the glove is improved.

Example 3

As shown in FIGS. 1 and 2, illustrate is an insulated glove, comprising a covering 1, a lining 2 and a plurality of heat insulators.

The covering 1 is made of 10-gauge, 13-gauge, 18-gauge or 21-gauge polyester-cotton blend materials or chemical fiber materials by a knitting technique. The lining 2 is a 7-gauge, 10-gauge, 13-gauge or 18-gauge looped pile glove made of acrylic fibers, spandex or nylon by a knitting technique. The lining 2 is sheathed in the covering 1 which forms a sandwich structure 4 together with the lining 2.

Each of the heat insulators 3 comprises a first connecting end 31 and a second connecting end 32 which are respectively connected to the covering 1 and the lining 2 via an adhesive, so that the covering 1 and the lining 2 are separated by the heat insulators 3, and a hollow structure having a same height with the heat insulators is formed in the sandwich structure 4 formed by the covering 1 and the lining 2. The covering 1 and the lining 2 are sealed at the opening of the glove by a sealing process, so a cavity 5 having a hollow structure is formed between the covering 1, the lining 2 and the heat insulators 3.

When hands are in a high temperature or an object of a high temperature is grasped by the hand, heat is transferred from the covering 1 to the cavity 5, and then transferred to the lining 2 via the heat insulators 3 and the air in the cavity 5, and finally to the hands via the lining 2.

In an embodiment, a dipped layer is provided on an outer side of the covering 1. The dipped layer is made from neoprene by a double dip molding. The heat resistances of the neoprene and the nitrile-butadiene rubber are comparable, but the flame resistance of the neoprene is optimal in general rubbers, because when the neoprene is burned, under the high temperature, the hydrogen peroxide gas is decomposed to put out the flame by itself. So the neoprene doesn't have a spontaneous ignition performance, and it burns when contacting with the flame, and the flame is put out by itself when it is separated with the flame. Thus it can be adapted to a high-temperature environment, such as casting, metallurgical and other industries.

Further, the dipped layer is provided with a sandblasting layer formed by a pressure blasting process. Driven by compressed air, abrasives are pressed into a sand pipe of the pressure dry sandblasting machine via an output valve, and then are ejected from a nozzle to the surface of the gloves which are dipped with the rubber. The rough glove sandblasted with abrasives being particles is more durable than the smooth sandblasted glove. The sandblasting layer thickens the glove, and according to the heat conduction mechanism, the heat conduction path and the heat transfer path are prolonged as the glove is thickened, which further reduce the heat transfer efficiency, so the insulating and anti-scald effect of the glove is improved.

In addition, on the one hand, the sandblasting layer reduces the possibility of are prolonged as the glove is thickened, which further reduces the heat transfer efficiency, so the insulating and anti-scald effect of the glove is improved.

In addition, on the one hand, the sandblasting layer reduces the possibility of accidents, such as crash and extrusion of objects, caused by slippage when the object is grasped by the worker. On the other hand, the roughness of the glove surface is increased to improve mechanical properties of the glove surface, such as the wearability, the cut resistance, the fatigue resistance, so that the service time of the glove is prolonged, where the service time of the sandblasting glove is 3-5 times that of ordinary gloves.

In some embodiments, the lining 2 is a10-gauge acrylic loop pile glove, and a thickness at thumb crotch of the lining is larger than that at other parts of the lining 2. When a large object is grasped with the glove, the thumb crotch of the hand suffers more pressures, and the cavity 5 of the glove is easily deformed by strong pressure, so the inner surfaces of the covering 1 and the lining 2 contact with each other, resulting a quick heat transfer between the solids, thus, the insulating and anti-scald effect is greatly reduced. In view of this, according to the path in the heat conduction mechanism, it is beneficial to prevent heat transfer and ensure the insulating and anti-scald effect by thickening the thumb crotch, i.e., prolonging the heat conduction path.

The glove of the present invention adopts a 10-gauge acrylic loop pile glove as the lining, so a cavity is formed between the inner surface of the lining 2 and the hand surface. When the heat is transferred to the hand surface via the lining 2, it is not directly transferred to the hand surface via a solid single path, such as rubber layers or knitted wires, but it is transferred to the hand surface via both the solid path and a gas path. According to the heat transfer coefficient of the solids and the air in Table 1, the heat transfer of the glove is further reduced, and the insulating and anti-scald effect of the glove is improved.

Heretofore, the present embodiment has been described in detail with reference to the accompanying drawings. Based on the above description, those skilled in the art should have a clear understanding of the present application.

It should be noted that an example of parameters containing specific values may be provided herein, but these parameters need not be exactly equal to the corresponding values, but may approximate the corresponding values within acceptable error tolerances or design constraints. The direction terms mentioned in the embodiments, such as "upper", "lower", "front", "back", "left", "right", etc., only refer to the directions of the drawings, and are not intended to limit the scope of the present application. In addition, the order of the above steps is not limited to the above, and may be varied or rearranged depending on the desired design, unless specifically described or necessarily occurring in sequence. The above embodiments may be used in combination with other embodiments in consideration of the design and reliability, i.e., the technical features in different embodiments may be freely combined to form more embodiments.

The above has described the embodiments of the present invention. It is should be understood that the invention is not limited to the embodiments described above, and various modifications and changes may be made by those skilled in the art without departing from the scope of the invention, which do not affect the substance of the invention.

I claim:

1. An insulated glove, comprising a covering, a lining and a plurality of heat insulators; wherein the lining is sheathed in the covering; the lining and the covering form a sandwich structure; each of the plurality of heat insulators comprises a first connecting end and a second connecting end which are respectively fixedly connected to the covering and the lining through adhesives, so that the heat insulators are located in the sandwich structure; a plurality of through holes are evenly provided on the heat insulators; a cavity capable of insulating heat is formed between the heat insulators, the lining and the covering; the heat insulators are columns, spheres or hemispheres; and the heat insulators adjacent to each other are arranged in point or line contact in the sandwich structure.

2. The insulated glove of claim 1, wherein a total volume of the heat insulators is 10-15% of a volume of the cavity.

3. The insulated glove of claim 1, wherein a distance between the first connecting end and the second connecting end ranges from 2 to 5 mm.

4. The insulated glove of claim 1, wherein the heat insulators are made of rubbers, PU or PVC materials by thermoforming.

5. The insulated glove of claim 1, wherein a dipped layer is provided on an outer side of the covering; and the dipped layer is made from neoprene by double dipmolding.

6. The insulated glove of claim 5, wherein the dipped layer is provided with a sandblasted layer formed by a pressure sandblasting process.

7. The insulated glove of claim 1, wherein the lining is a 10-gauge acrylic loop pile glove; and a thickness at thumb crotch of the lining is larger than that at other parts of the lining.

* * * * *